US005803255A

United States Patent [19]

Peeters et al.

[11] Patent Number: 5,803,255

[45] Date of Patent: Sep. 8, 1998

[54] LIGHTTIGHTLY PACKAGED ROLL OF LIGHT-SENSITIVE FILM

[75] Inventors: Dirk Peeters, Kontich; Danny Van Geyte, Schilde, both of Belgium

[73] Assignee: Agfa-Gevaert N.V., Mortsel, Belgium

[21] Appl. No.: 631,918

[22] Filed: Apr. 15, 1996

[30] Foreign Application Priority Data

Apr. 18, 1995 [EP] European Pat. Off. ..... 95200966

[51] Int. Cl.[6] ..... B65D 85/66

[52] U.S. Cl. ..... 206/398; 206/409; 206/410; 206/414

[58] Field of Search ..... 206/389, 398, 206/402, 407, 409, 410, 413, 414, 415, 416

[56] References Cited

U.S. PATENT DOCUMENTS

| | | | |
|---|---|---|---|
| 2,067,111 | 1/1937 | Aberle | 206/410 |
| 2,883,045 | 4/1959 | Abramson | 206/410 |
| 4,516,892 | 5/1985 | Curro, Jr. | 206/413 |
| 4,733,777 | 3/1988 | Van Geyte et al. | 206/316 |
| 4,911,299 | 3/1990 | Peeters | 206/410 |
| 5,133,171 | 7/1992 | Chase et al. | 206/414 |
| 5,145,065 | 9/1992 | Mizutani et al. | 206/407 |
| 5,336,085 | 8/1994 | Kewin | 206/407 |
| 5,413,221 | 5/1995 | Mizuno | 206/416 |
| 5,492,221 | 2/1996 | Light et al. | 206/398 |

*Primary Examiner*—Paul T. Sewell
*Assistant Examiner*—Nhan T. Lam
*Attorney, Agent, or Firm*—Brumbaugh, Graves, Donohue & Raymond

[57] ABSTRACT

A lighttightly packaged roll (10) of light-sensitive film wound on a hollow supporting core (15), which comprises a lighttight flexible end cover (11, 12) for each end surface of the roll, and a lighttight flexible circumferential cover (13) secured to the film and covering the outermost convolution thereof, the inside faces of the rims (22, 24) of the circumferential cover being sealed to the corresponding inside faces of the rims (21, 23) of the end covers, and the sealed rims of the lighttight wrapping thus formed having a bending all along their circumference towards the circumferential cover of said wrapping.

9 Claims, 4 Drawing Sheets

LIGHTTIGHTLY PACKAGED ROLL OF LIGHT-SENSITIVE FILM

BACKGROUND OF THE INVENTION

1. Field of the Invention

The present invention relates to a lighttightly packaged roll of light-sensitive strip material wound on a hollow supporting core, and more in particular to such roll which is intended for daylight loading of a dispenser magazine which, after its loading, can be placed in a suitable exposure apparatus, e.g. a phototypesetter or a COM (computer output microfilm) system.

2. Description of the Prior Art

Lighttightly packaged rolls of light-sensitive strip material wound on a hollow supporting core are known, which comprise a lighttight flexible end cover for each end surface of the roll, each end cover having a central opening and being lighttightly attached to a corresponding end of the core, a lighttight flexible circumferential cover secured to the coiled strip material and covering the outermost convolution of the roll. Corresponding ends of end covers and circumferential cover are lighttightly fitted to each other so as to obtain a lighttight and/or moisture-tight wrapping. Examples of this kind of wrapping are disclosed in U.S. Pat. No. 4,148,395 and 4,505,387. An improved roll packaging which overcomes problems with dimensional tolerances of the roll of wound strip material is disclosed in U.S. Pat. No. 4,733,777.

The latter roll package comprises a lighttight flexible end cover for each end surface of the roll, each end cover having a diameter in excess of the diameter of the roll of wound material, and a lighttight flexible circumferential cover having a width in excess of the width of the strip material. The inside faces of the rims of the circumferential cover are sealed to the corresponding inside faces of the rims of the end covers extending beyond the perimeter of the roll of wound strip material.

A roll package as described is supported between two rigid flanges having a hub engaging the corresponding core opening, and the roll thus supported is packed in a rectangular cardboard box for storage and shipping. Contact of the flanges with the sealed rims of the wrapping material locates said rims in parallel planes, normal to the axis of the roll. Since the flanges have a diameter, or circumscribe a diameter if they are rectangular, which is larger than the diameter of the rims in their normal planes, there is no contact between the edges of the rims and the adjacent walls of the packaging box.

In view of today's environmental considerations, the flanges, which usually are made of a hard plastic such as polystyrene or polyvinyl chloride, are considered as an undesirable load.

We have found that omission of the mentioned flanges from the packing box is detrimental to the quality of the sealed rims of the wrapping material. As a matter of fact, repeated moving contact between the outer edges of said rims and the adjacent walls of the box during transport and/or other manipulations of the boxes causes uncontrolled compression and alternating bending of the rims whereby their lighttight sealing can get destroyed.

SUMMARY OF THE INVENTION

Object of the Invention

It is an object of the present invention to provide a roll package of light-sensitive strip material wound on a core and lighttightly wrapped in a wrapper having rims of a circumferential cover and of end covers sealed at their inside to each other, which readily lends itself to be packaged in a cardboard packing box without the use of rigid flanges for supporting such roll in such box.

Statement of the Invention

In accordance with the present invention, a lighttightly packaged roll of light-sensitive strip material wound on a hollow supporting core, which comprises a lighttight flexible end cover for each end surface of the roll, each end cover having a central opening and being lighttightly attached to a corresponding end of the core and each end cover further having a diameter in excess of the diameter of the roll of wound material, and a lighttight flexible circumferential cover secured to the coiled strip material and covering the outermost convolution thereof, said circumferential cover having a width in excess of the width of the strip material, the inside faces of the rims of the circumferential cover being fitted to the corresponding inside faces of the rims of the end covers extending beyond the perimeter of the roll of wound strip material, is characterized thereby that the fitted rims of the lighttight wrapping thus formed have a bending all along their circumference towards the outer surface of said wrapping.

The bending of the fitted rims of the lighttight wrapping can occur either towards the circumferential portion of the wrapping or to the corresponding end covers thereof. In both cases the rims have a form such that any contact with a corresponding wall of the packing box causes a force that is directed almost normal to the outer face of the rim. This is completely distinct from the prior art package in which the rims are oriented outwardly in a plane that is normal to the axis of the roll, so that abutting contact of the outer edges of the rims with a wall of the box can cause a corresponding rim portion to buckle, split or get a tortuous deformation. It should be noted that suchlike local deformations of a sealed rim do not only have consequences for the lighttightness of the wrapping but also for the unwinding characteristics of the wound material. As a matter of fact, a sealed rim that has become seriously buckled, or folded and next displaced inwardly of the roll, i.e. in the direction of the opposite rim, will not become uniformly redressed by tearing off the circumferential cover at the opening of the wrapping, so that further unwinding of the coiled strip material will be hampered by periodic shockwise contact of the damaged rim portion with the corresponding edge of the unwinding strip. This can damage the light-sensitive coating of the unwound strip material, and/or disturb the smooth unwinding of the strip and so its satisfactory exposure, e.g. by laser scanning, as it is being unwound.

The bent rims of the wrapping can be formed in different ways. According to one technique, the rims are bent after they have been fitted to each other. A common procedure for fitting the rims to each other is heatsealing. The bending of the rims can suitably occur by rotating the wrapped roll about its axis and progressively bending the rims by sliding or rolling contact with an appropriate deflector.

According to another technique, the rims are given their ultimate shape, or approximately so, and then the rims are fitted to each other. The latter technique can afford a bent rim which is more formproof than the first one.

However, whether one or the other technique is used and whether the bending of the rims is small or large, the very fact that the rims do have a bending either towards the circumferential or to an end cover make that the rims will exhibit a preferred and controlled behaviour upon contact with a wall of the box, viz. the tendency to further bend in a well-determined direction as a consequence of such contact.

Suitable embodiments of a packaged roll according to the invention are as follows.

The circumferential cover and the end covers have on their inside a thermoplastic layer, and the fitting of the corresponding rims occurs by heatsealing such layers.

The circumferential edge of the rim of the end covers extends slightly beyond the corresponding edge of the folded rim of the circumferential cover so hat the freely exposed portion of the rim of the circumferential cover screens so to say the head side of the sealed rim. This measure counts for rims folded towards the circumferential cover. It is clear that for rims folded towards the end covers, it is desirable for the circumferential cover to slightly extend beyond the end covers.

Packing a roll wrapped as described hereinbefore in a cardboard box without axial support of the roll can cause dust by repeated frictional contact of the roll with the inside surfaces of the walls of the box during transport and other manutentions of the box.

Dust that is adherent to the lighttight wrapper of the roll becomes captured by e.g. the velvet liners of the dispenser slot of the magazine into which the roll is loaded, and will next be progressively transferred to a film as the latter is pulled out through such liners.

The presence of dust is less critical for photographic paper than for photographic film.

Therefore, according to a further preferred embodiment of the invention, a lighttightly packaged roll of light-sensitive film is wrapped in a dustproof foil before it is packed in a cardboard packing box. Such foil can be kept closed by means of overlapping longitudinal margins, and by end portions tucked in the open ends of the core of the wrapped roll. Such foil suitably is uncolored in order to not mislead the user about the actual purpose thereof.

BRIEF DESCRIPTION OF THE DRAWINGS

The invention will hereinafter be described by way of example with reference to the accompanying drawings, wherein.

DETAILED DESCRIPTION OF THE INVENTION

Figure 1:
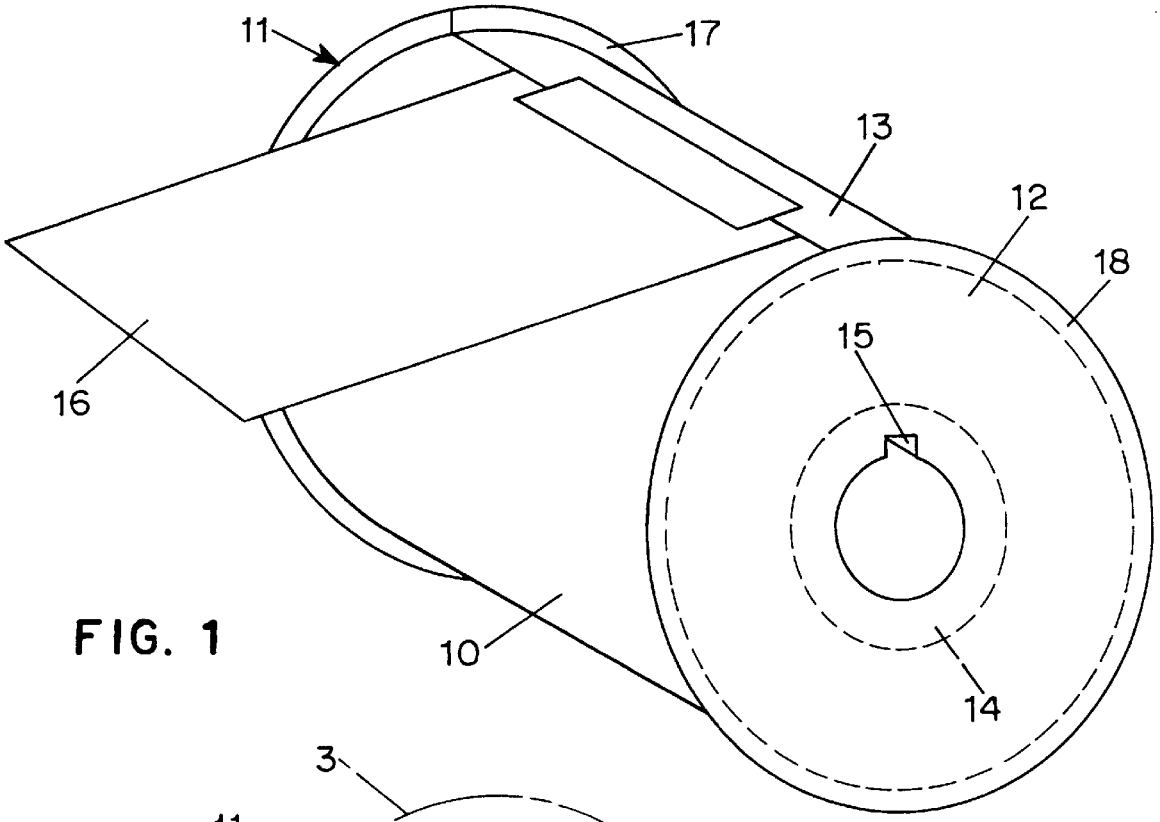
FIG. 1 is a perspective view of a prior art roll package.

Referring to FIG. 1, a lighttightly packaged roll 10 of light-sensitive film comprises two end covers 11 and 12, and a circumferential cover 13 sealed to said end covers, as a lighttight wrapping for a light-sensitive film. Rim 14 of the central opening of the end covers is lighttightly fitted to core 15 of the film roll. In the present case, covers 11, 12 and 13 comprised an inner layer of polyethylene which allowed heatsealing of the covers to each other and to the core. The packaged roll has a leader 16 protruding from the circumferential cover and allowing starting unwinding of the roll after the roll has been placed in a suitable magazine. Roll 10 is packaged in a shipping carton, not shown, by means of two supporting flanges having a hub engaging the core opening and a diameter which is larger than the diameter of the end covers. Sealed rims 17, 18 of the covers are urged by contact with the supporting flanges in a plane normal to the axis of the roll, as shown. A roll package as described is disclosed in U.S. Pat. No. 4,733,777 mentioned in the introduction, and is on the market under the trade name AGFA DATAREX of AGFA-GEVAERT N.V., Mortsel-Belgium.

Figure 2:
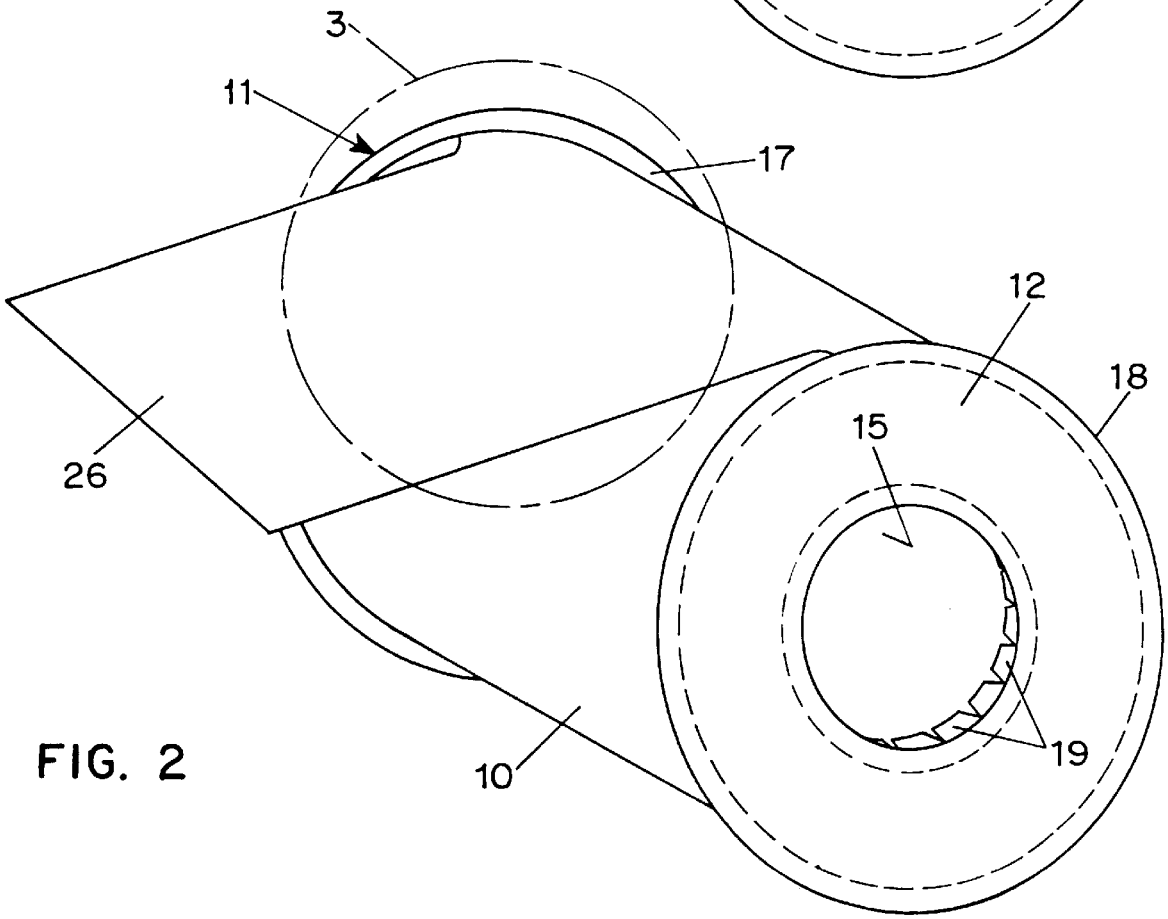
FIG. 2 is a perspective view of one embodiment of an improved package according to the present invention.

FIG. 2 shows one embodiment of an improved roll package in accordance with the invention. Parts having the same function as the corresponding parts of FIG. 1 received the same numeral. In the present embodiment, the lighttight fitting of end covers 11 and 12 to core 15 occurred by means of lips 19 tucked in the core opening and heatsealed to the inside surface of the core. The core of the film roll in the present embodiment was made from cardboard, as distinct from the core of the FIG. 1 embodiment which is a plastic one. The heatsealing of the end covers by means of lips 19 is disclosed in EP Patent 0 350 093.

Also different from the FIG. 1 arrangement is roll leader 26 in FIG. 2 which now is an extension of slightly reduced width of peripheral cover 13 and which is not fitted to the end covers. Peripheral cover 13 itself is sealed to the end of the film of the roll. This arrangement has the advantage that no film material is lost, contrary to FIG. 1, upon loading a magazine and pulling until the peripheral cover has been removed and the film comes out of the dispenser slot of the magazine.

Figure 3:
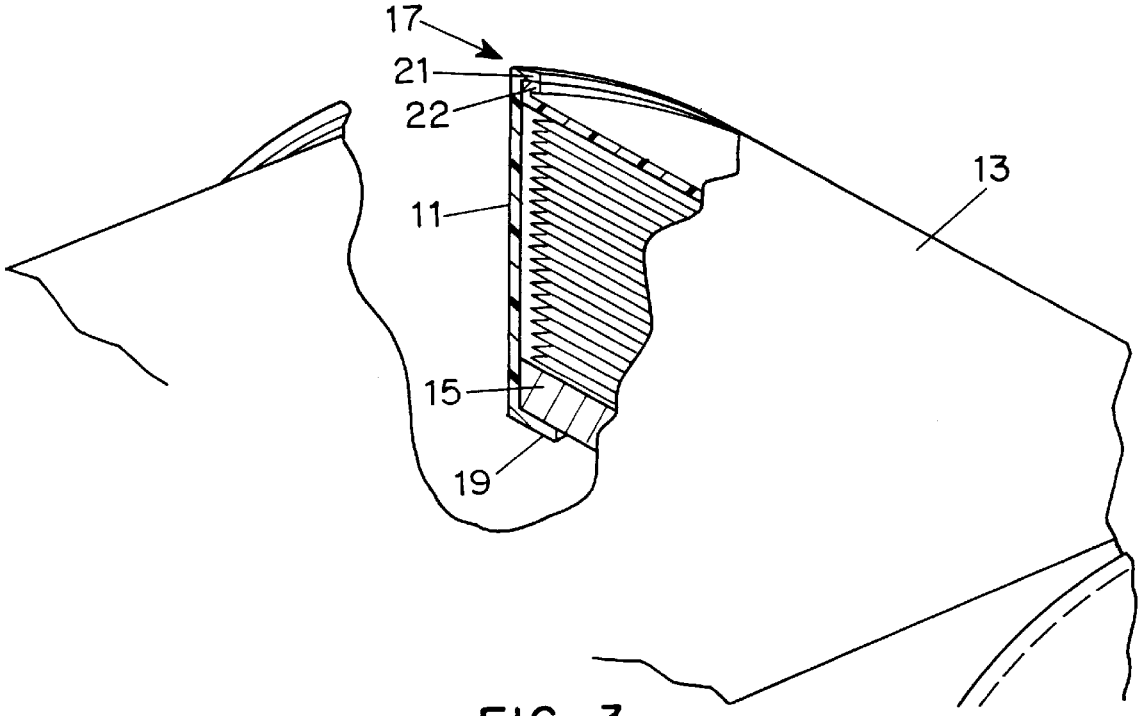
FIG. 3 is an enlarged view of detail 3 of FIG. 2.

Sealed rims 17 and 18 are bent towards circumferential cover 13 as shown diagrammatically in detail in FIG. 3 which is an enlarged view of portion 3 of FIG. 2. Sealed rim 17 is an assembly of rim 21 of end cover 11 and of rim 22 of circumferential cover 13. The fitting of both rims to each other occurred in the present example by heatsealing the inside thermoplastic layers of both covers to each other, but can be done also in other ways, such as by glueing, interposition of a two-sided adhesive ribbon or the like.

Figure 4:
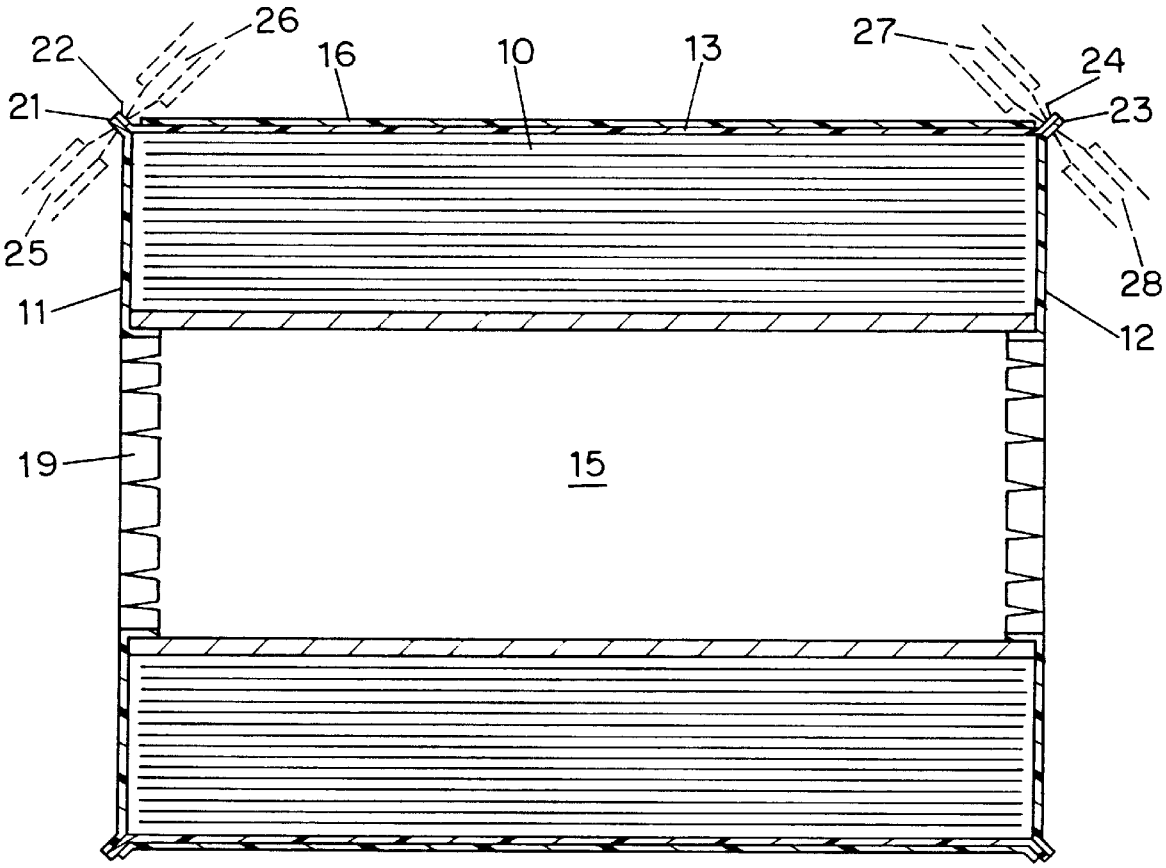
FIG. 4 is a diagrammatic longitudinal sectional view of the package of FIG. 2 illustrating the sealing of the rims of the lighttight wrapper.

The sealing of the rims can occur as shown in FIG. 4. End covers 11 and 12 are applied against the lateral ends of wound roll 10 and fixed to the core thereof by means of lips 19 that are sealed to the inside of the core. Next rims 21, 23 of both end covers and 22, 24 of the circumferential cover are urged together at an angular position of approximately 45° with respect to the end face of the roll, and sealed in this position by means of two opposed heated roller pairs 25, 26 and 27, 28 shown in broken lines which progressively seal the rims while the roll is rotated. This technique has been described in U.S. Pat. No. 4,733,777 mentioned hereinbefore. The rims are next bent towards each other, i.e. in the direction towards circumferential cover 13, e.g. by means of rolling or sliding contact with appropriate guides that deflect and bend the rims. The material of the wrapping foils, in particular that of the end covers, becomes stretched by this bending so that the rims maintain their bent shape.

Figure 5:
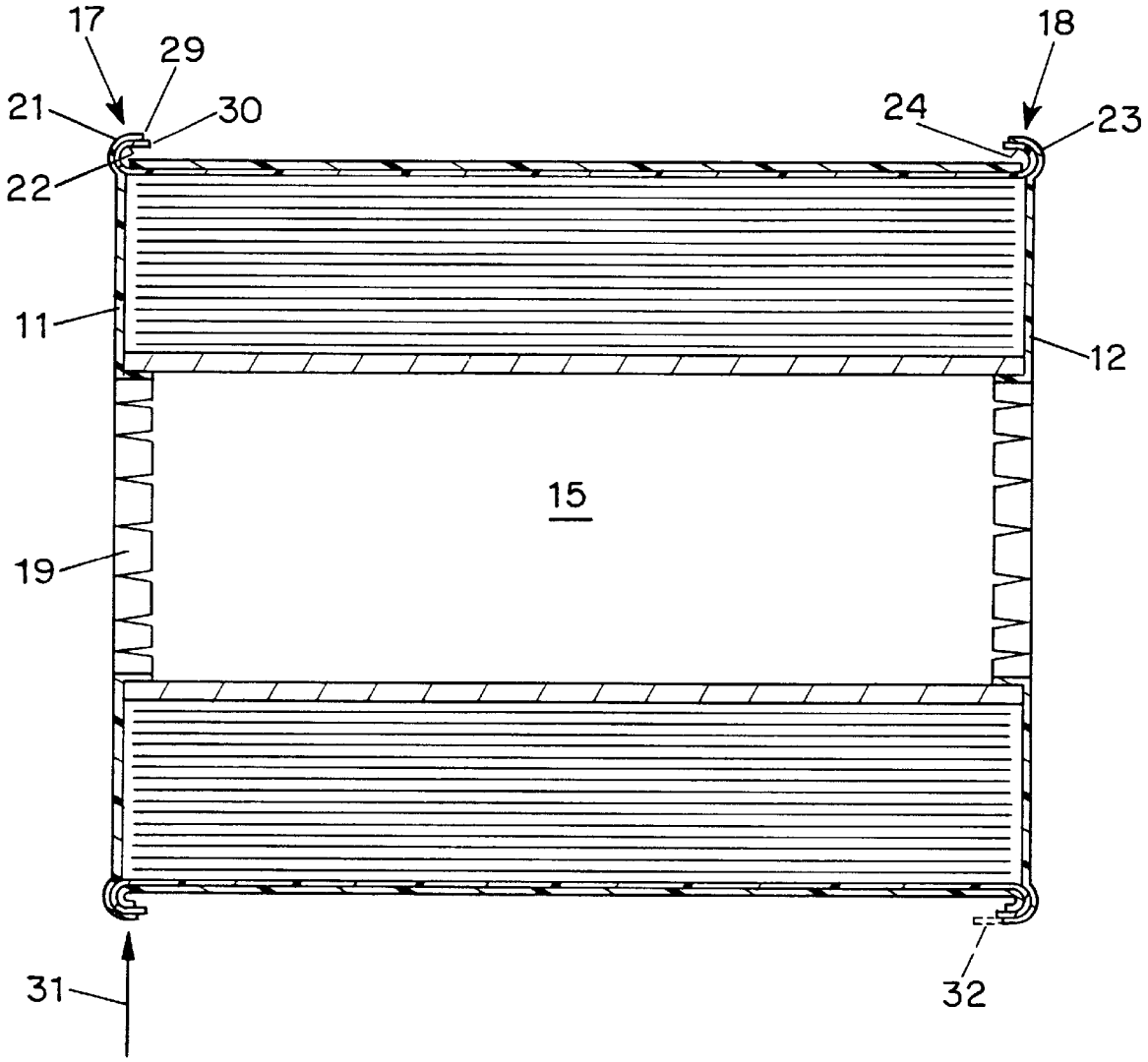
FIG. 5 is a diagrammatic longitudinal sectional view illustrating the bent rims.

According to another technique, the rims are bent in the desired direction and, while in this position, their sealing is made. This has the advantage over the former technique that a true "form sealing" is obtained which may keep its shape over a longer period of time. The drawing of FIG. 5 shows such "form sealed" rims 17 and 18 and it will be apparent that edge 29 of rim 21 is located slightly backwards with respect to corresponding edge 30 of rim 22 because of its larger radius of curvature. In those cases wherein the exposed extended portion of the inner rim could be the cause for damage of the seal by contact with the adjacent wall of the shipping carton, as indicated diagrammatically by arrow 31 for the lower side of the drawing, which represents a radial load, the diameter of the end covers can be increased so as to obtain an "overlapped" seal as illustrated diagrammatically in broken lines 32 in FIG. 5.

Figure 6:
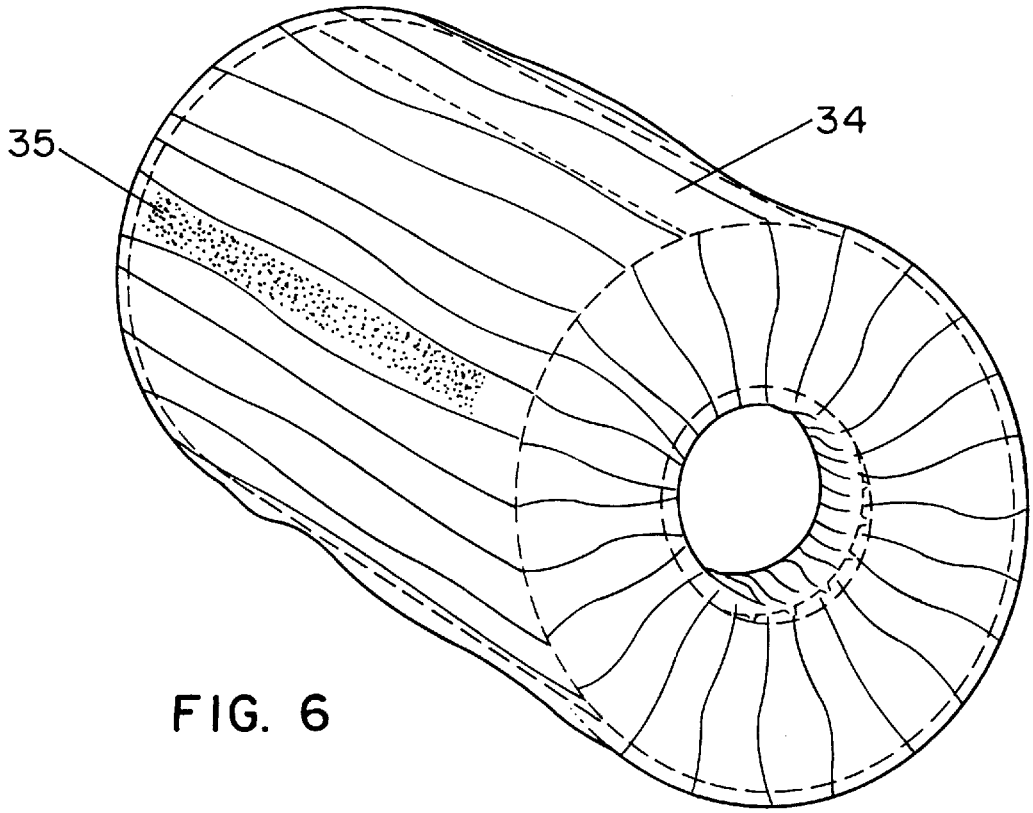
FIG. 6 is the package of FIG. 2, wrapped in a dustproof foil.

The film roll packaged and treated as described hereinbefore can then be wrapped in a protective wrapping foil 34 as illustrated in FIG. 6. The foil has a rectangular shape and the film roll is rolled in the foil with the two longitudinal foil margins, running parallel to the roll axis, overlapping each other. One of these margins can be provided with a self-adhesive, peelable seal 35, e.g. one obtained through fiberisation of a self-adhesive hotmelt on such margin. Next the ends of the wrapper are tucked in the open ends of the roll core.

Figure 7:
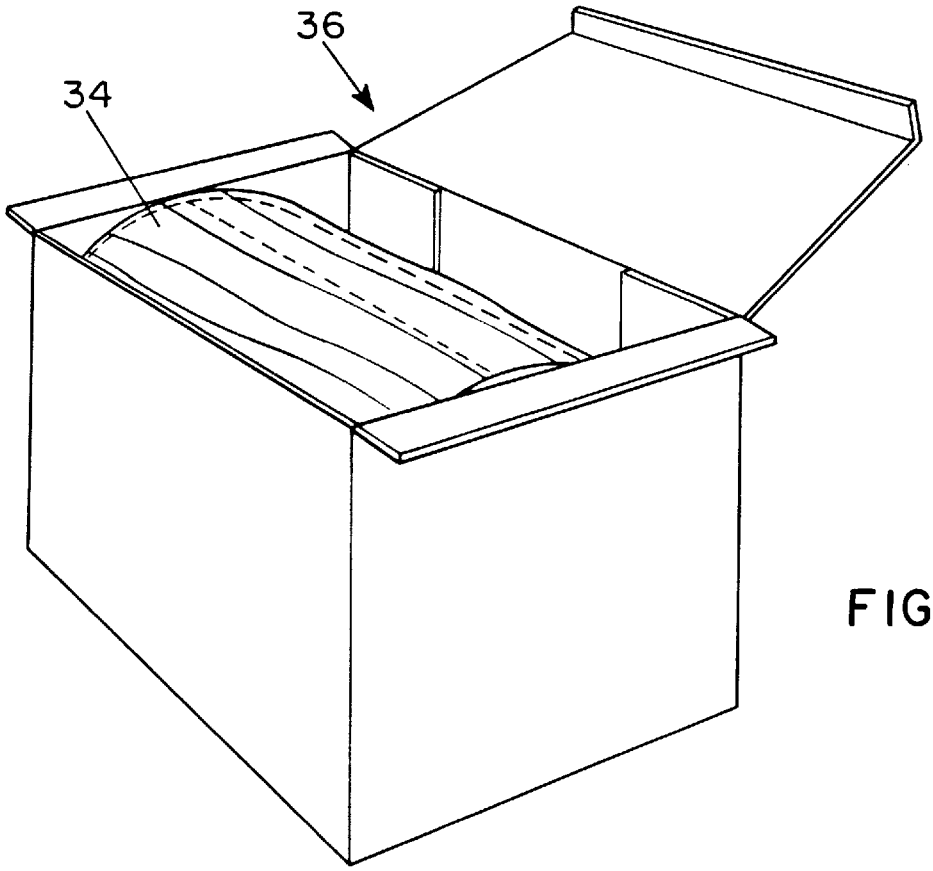
FIG. 7 shows the package of FIG. 6 packed in a cardboard box.

The film roll thus wrapped is finally placed in a cardboard shipping carton 36 as shown in FIG. 7, without use of conventional supporting flanges. The bent roll rims are locally slightly flattened by their contact with the bottom wall of the carton but this contact is in no way detrimental to the lighttightness of the wrapping since the sealed rims only exhibit forces or components thereof that are normal or Approximately so to their surface. Movement of the film roll in the shipping carton during transport and other manutentions may cause dust resulting from rubbing contact with the cardboard walls, and this dust could settle on the lighttight wrapping of the film roll if there were no protective wrapper 34 as shown in FIG. 6. Since this wrapper has no light protecting function as such, it may be advantageous to use for this wrapper a translucent or even transparent foil in order not to mislead the user of the film roll about the actual function of the wrapper.

A film package according to the present invention is not limited to the illustrated embodiment.

Referring to the drawings of FIGS. 3 and 5, it should be understood that the sealed rims may be bent in the opposite direction as well, so that they get a shape wherein their bending is towards the outer surface of the circumferential covers. Loading of the sealed rims in a direction which runs parallel with, or nearly so, with the axis of the film roll causes increased bending of the rims, without giving rise to increased risk for destroying the lighttightness of the seals.

The lighttight fitting of the central opening of the end covers to the core can also occur in other ways. As an example we refer to EU-A1-0 579 216 which discloses clamping a margin of said opening into the core by means of a ring.

We claim:

1. A light-tightly packaged roll of a light-sensitive strip material to be packed in a cardboard box, the light-tightly packaged roll comprising:

a hollow supporting core with a first end and a second end on which the light-sensitive strip material is wound;

a first substantially annular, light-tight, flexible end cover lighttightly attached to the first end of the hollow supporting core, and a second substantially annular, light-tight, flexible end cover light-tightly attached to the second end of the hollow supporting core, each end cover having an outer diameter greater than the diameter of the roll of light-sensitive strip material, the difference in diameters between the first end cover and the roll and the second end cover and the roll defining a first rim area and a second rim area, respectively;

a circumferential cover comprising a strip of lighttight flexible material, which is attached to the roll of light-sensitive strip material and wound around the roll for at least one full revolution, the circumferential cover having a width greater than the width of the light-sensitive strip material, such that the circumferential cover has a first overhanging edge and a second overhanging edge over the sides of the roll;

the first rim area being light-tightly attached to the first overhanging edge and the second rim area being light-tightly attached to the second overhanging area, thereby producing a first sealed rim and a second sealed rim, respectively;

the first and second sealed rims being bent acutely toward an outer surface of the light-tightly packaged roll; and the cardboard box being without a flange means disposed therein for supporting the roll through engagement with the roll's hollow supporting core and for keeping the outer surfaces of the roll out of contact with the walls of the box.

2. A light-tightly packaged roll according to claim 1, wherein the first and second sealed rims are bent acutely toward the outer surface of the circumferential cover.

3. A light-tightly packaged roll according to claim 1, wherein the first sealed rim is bent acutely toward the outer surface of the first end cover and the second sealed rim is bent acutely toward the outer surface of the second end cover.

4. A light-tightly packaged roll according to claim 1, wherein the first and second sealed rims are produced by heatsealing the first and second rim areas to the first and second overhanging edges, respectively.

5. A light-tightly packaged roll according to claim 1, wherein the first and second rim areas and the first and second overhanging edges are bent before they are attached together, thereby producing preformed sealed rims.

6. A light-tightly packaged roll according to claim 1, which is additionally wrapped in a dustproof wrapper.

7. A light-tightly packaged roll according to claim 6, wherein the wrapper is a foil having overlapping longitudinal margins and end portions tucked into the ends of the hollow supporting core.

8. A light-tightly packaged roll according to claim 6, wherein the wrapper is transparent.

9. A light-tightly packaged roll according to claim 1, wherein the circumferential cover has a leading end that is not attached to the first and second end covers.

* * * * *

UNITED STATES PATENT AND TRADEMARK OFFICE

CERTIFICATE OF CORRECTION

PATENT NO. : 5,803,255

DATED : September 8, 1998

INVENTOR(S) : Peeters et al.

It is certified that error appears in the above-identified patent and that said Letters Patent is hereby corrected as shown below:

First Page of Patent, Column 2, [56] U.S. PATENT DOCUMENTS: "5,336,085 8/1994 Kewin" shoul read -- 5,366,085 11/1994 Kewin --.

Signed and Sealed this

Eleventh Day of April, 2000

*Attest:*

*Attesting Officer*

Q. TODD DICKINSON

*Director of Patents and Trademarks*